US006463919B1

(12) United States Patent
Skinner et al.

(10) Patent No.: US 6,463,919 B1
(45) Date of Patent: Oct. 15, 2002

(54) IGNITION COIL WITH POLYIMIDE CASE AND/OR SECONDARY SPOOL

(75) Inventors: Albert Anthony Skinner, Anderson; Colin Hamer, Noblesville; Mark Albert Paul, Fishers; David D. Jackson, Anderson, all of IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/961,873

(22) Filed: Sep. 24, 2001

(51) Int. Cl.[7] ..... F02P 1/00
(52) U.S. Cl. ..... 123/634
(58) Field of Search ..... 123/634, 635, 123/637, 638, 434

(56) References Cited

U.S. PATENT DOCUMENTS 5,716,223 A 2/1998 Phillips, Jr. et al. ..... 439/125
5,870,012 A 2/1999 Sakamaki et al. ..... 336/107
5,977,856 A * 11/1999 Maekawa et al. ..... 123/634
6,216,679 B1 * 4/2001 Skinner et al. ..... 123/635
6,322,458 B1 * 12/2001 Shimada et al. ..... 123/634
6,343,595 B1 * 2/2002 Nakabayashi et al. ..... 123/634

* cited by examiner

*Primary Examiner*—Bibhu Mohanty
(74) *Attorney, Agent, or Firm*—Margaret A. Dobrowitsky

(57) ABSTRACT

An ignition coil assembly includes a cylindrical central core having a main axis, a primary winding outwardly of the central core, a secondary winding outwardly of the primary winding, and a case comprising polyimide material. In one embodiment, a secondary winding spool comprises polyimide material. The overall diameter of the ignition coil assembly is reduced relative to conventional designs.

15 Claims, 1 Drawing Sheet

IGNITION COIL WITH POLYIMIDE CASE AND/OR SECONDARY SPOOL

BACKGROUND OF THE INVENTION

1. Technical Field

The present invention relates generally to ignition coils for developing a spark firing voltage that is applied to one or more spark plugs of an internal combustion engine and more particularly to an ignition coil with a polyimide case or secondary winding spool.

2. Description of the Related Art

Ignition coils utilize primary and secondary windings and a magnetic circuit. The magnetic circuit may include a core formed of steel laminations, as disclosed in U.S. Pat. No. 5,870,012 to Sakamaki et al. Sakamaki et al. disclose an ignition coil having a relatively slender configuration adapted for mounting directly above a spark plug—commonly referred to as a "pencil" coil. The ignition coil of Sakamaki et al. has a core composed of laminations of iron plates nearly circular in radial cross-section. Sakamaki et al. further disclose a bobbin disposed radially outwardly of the core having a primary coil wound thereon, another bobbin disposed radially outwardly of the primary coil having a secondary coil wound thereon, and a case disposed outwardly of the secondary coil. An outer or side core is outwardly of the windings. An ongoing problem, however relates to space. The bobbins and case occupy valuable space. This has the result of a larger ignition coil. If there are restrictions or limitations on the overall outside diameter of the ignition coil, the space occupied by the bobbins and case displace, in-effect, spaced or volume that could otherwise be occupied by energy storage materials. Thus, for example, the central core volume may be reduced accordingly, thereby reducing ignition coil performance, or, perhaps, requiring that expensive magnets be included in the magnetic circuit to meet performance requirements. In some instances, the combination of a very limited overall outside diameter and a predetermined energy delivery level simply cannot be met using conventional approaches.

One approach taken in the art involves an ignition coil configuration wherein the primary winding is outwardly of the secondary winding, and used in connection with a multi-piece case to obtain a reduced thickness wall in the area of the HV transformer. However, energy density concessions are made with this approach, as described in greater detail below.

Thus, an ignition coil configuration such as disclosed in Sakamaki et al. (i.e., a design where the secondary winding is outwardly of the primary winding, and a shield outwardly of the case) provides a higher energy delivery capability than an ignition coil where the primary winding is wound external to the secondary winding. This is due principally because the primary winding can be wound directly on the central core, thereby eliminating the need for a primary winding spool, and thus allowing for an increased size central core. However, the foregoing arrangement imposes a high dielectric stress on the case located between the secondary winding and the side core or shield. That is, the electric field (E-fields) intensity is too high for prolonged and repeated exposure to the case. This condition leads to material failure (e.g., and allowing corona discharge), which in turn results in failure of the ignition coil as a whole if allowed to continue unabated.

There is therefore a need for an improved ignition coil assembly that minimizes or eliminates one or more of the problems set forth above.

SUMMARY OF THE INVENTION

One advantage of an ignition coil assembly according to the invention is that it provides a smaller coil design with respect to overall outside diameter. Another advantage of the present invention is that it provides a lower cost ignition coil by allowing a larger central core of either a reduced cost steel (e.g., M-27 instead of M-6, as is conventionally used for a central core) or, alternatively, by allowing one or more permanent magnets to be removed (i.e., maintain the same performance by providing a larger core, thereby allowing removal of the one or more permanent magnets). These and other advantages, features and objects are realized if either the case alone comprises polyimide material, or the secondary spool alone comprises polyimide material. If both the case and secondary winding spool comprise polyimide material, then the advantages and benefits are increased along with the additional advantage of having an increased temperature capability ignition coil.

An ignition coil assembly according to the invention includes a central core, a primary winding, a secondary winding, and a case. The central core is generally cylindrical and is formed along a main axis. The primary winding is disposed about the central core and is connected to a power source. The secondary winding is wound on a spool that is configured to be connected to a spark plug. The secondary winding is located radially outwardly of the primary winding. The case is located radially outwardly of the secondary winding and comprises a tube formed of polyimide material.

In a preferred embodiment, the spool comprises a second tube formed of polyimide material.

BRIEF DESCRIPTION OF THE DRAWINGS

The present invention will now be described by way of example, with reference to the accompanying drawings.

DETAILED DESCRIPTION OF THE PREFERRED EMBODIMENTS

Figure 1:
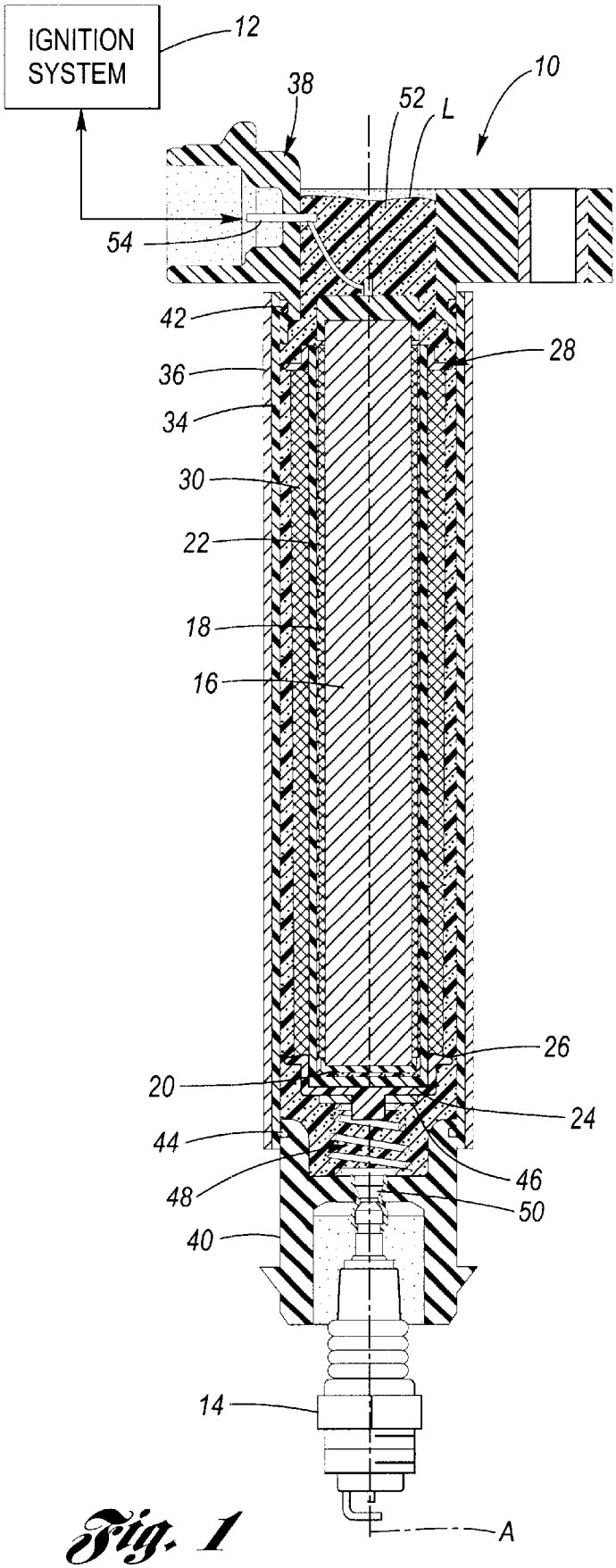
FIG. 1 is a simplified, cross-section view of an ignition coil in accordance with the present invention.

Referring now to the drawings wherein like reference numerals are used to identify identical components in the various views, FIG. 1 is a simplified, cross-section view of an ignition coil 10 in accordance with the present invention. As is generally known, ignition coil 10 may be coupled to, for example, an ignition system 12, which contains primary energization circuitry for controlling the charging and discharging of ignition coil 10. Further, also as is well known, the relatively high voltage produced by ignition coil 10 is provided to a spark plug 14 (shown in phantom-line format) for producing a spark across a spark gap thereof, which may be employed to initiate combustion in a combustion chamber of an engine. Ignition system 12 and spark plug 14 perform conventional functions well known to those of ordinary skill in the art.

Ignition coil 10 is adapted for installation to a conventional internal combustion engine through a spark plug well onto a high-voltage terminal of spark plug 14, which may be retained by a threaded engagement with a spark plug opening into the above-described combustion cylinder. Ignition coil 10 comprises a substantially slender high voltage transformer including substantially, coaxially arranged primary and secondary windings and a high permeability magnetic core.

Referring to FIG. 1, in accordance with the invention, ignition coil 10 includes a core 16, a primary winding 18, a rubber core buffer 20, a first tube 22 having a closed end 24 comprising polyimide material, a first cup-shaped winding flange 26, a second winding flange 28, a secondary winding 30, a low-voltage terminal 32 (best shown in FIG. 2), a second tube 34 comprising polyimide material, a magnetically-permeable side core or shield 36, a low-voltage (LV) connector assembly 38, and a high-voltage (HV) connector assembly 40.

FIG. 1 further shows a first O-ring 42, a second O-ring 44, a high-voltage (HV) terminal 46, and electrical connectors such as a spring 48, a spark plug HV terminal connector 50, encapsulant such as epoxy potting material, or liquid silicone rubber (LSR), described in greater detail below, and a plurality of low voltage pin terminals 54.

Core 16 may be elongated, having a main, longitudinal axis "A" associated therewith. Core 16 comprises magnetically permeable material, for example, a plurality silicon steel laminations (not shown); preferably, however, core 16 is a compression molded item comprising insulated iron particles, as known. Core 16 may therefore be a conventional core known to those of ordinary skill in the art. Core 16, in the preferred embodiment, takes a generally cylindrical shape (which is a generally circular shape in radial cross-section).

The space saved by one or both of a polyimide secondary winding spool or case may allocated to providing addition core volume and/or copper volume (e.g., for windings). This additional core/copper results in an improved magnetic circuit, and thus, improved performance of ignition coil 10, all other factors being the same. Finally, the capability of providing more core volume yields more options as to the type of core material to meet a particular design specification.

Primary winding 18, as shown, is wound directly onto core 16. Primary winding 18 includes first and second ends (not shown) and is configured to carry a primary current $I_P$ for charging coil 10 upon control of ignition system 12. Winding 18 may be implemented using known approaches and conventional materials.

In a first preferred embodiment according to the invention, a polyimide tube and other components are used in place of a conventional materials for the secondary winding spool. For example, such conventional materials include plastic material such as Polyphenylene Oxide (PPO)/Polystyrene (PS) (e.g., NORYL® IGN320 available from General Electric, New York N.Y. USA) or polybutylene terephthalate (PBT) thermoplastic polyester. The polyimide secondary winding spool embodiment will be described first, and may be used with either (i) conventional case configuration formed of thermoplastic molding material such as PBT, or (ii) in combination with a case comprising a polyimide tube, as described below.

FIG. 1 shows a cross section of first polyimide tube 22 having closed end 24, first flange 26 and second flange 28. Tube 22 and flanges 26, 28 cooperate to provide the mechanical winding-retaining and electrical insulative functionality of a conventional secondary winding spool. Such components are formed generally of electrical insulating material having structural properties suitable for use in a relatively high temperature environment.

Tube 22 is configured to receive and retain secondary winding 30. Tube 22 is disposed adjacent to and radially outwardly of the central components comprising core 16 and primary winding 18, and, preferably, is in coaxial relationship therewith.

Tube 22 in the illustrated embodiment may be an extruded polyimide tube having a closed end 24, and having a wall thickness of between about 0.38 mm to 0.50 mm. This thickness is required in order to withstand high voltages produced during operation of the ignition coil, having due regard for minimizing size.

Flange 26 is generally annular in shape and includes a flange surface that radially tapers in an open orientation (rather than a closed orientation) for winding purposes. Flange 26 may be formed of thermoplastic material such as PPO/PS (e.g., NORYL® IGN320).

Flange 26 may also includes features to allow termination of a high voltage end of secondary winding 30, such as by inclusion of a high-voltage (HV) terminal 46, as shown. Flange 26 may be configured to allow HV terminal 46 to be pressed unto the bottom side thereof, as shown. Alternatively, HV terminal 46 may be insert molded. One of ordinary skill in the art will recognize the possible variations to accomplish the described functionality.

Figure 2:
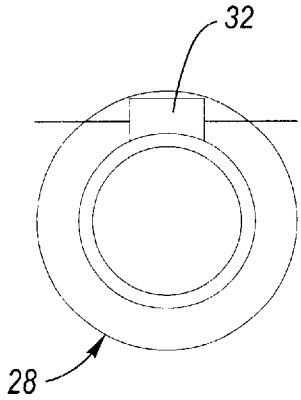
FIG. 2 is a top view of the secondary spool (formed of polyimide) with flanges.

As shown in FIG. 2, flange 28 is also generally annular in shape and includes a flange surface that is substantially perpendicular to an outer surface of tube 22, in the illustrated embodiment (best shown in FIG. 1). Flange 28 may be formed of thermoplastic material such as PPO/PS (e.g., NORYL® IGN320). Flange 28 may also include features to allow termination of a low voltage end of secondary winding 30, such as by inclusion of a low-voltage (LV) terminal 32, as shown. Flange 28 may be configured to allow LV terminal 32 to be pressed unto the top side thereof, as shown in FIG. 2. Alternatively, LV terminal 32 may be insert molded or otherwise affixed in ways known to those of ordinary skill in the art.

FIG. 1 shows secondary winding 30. Secondary winding 30 may comprise, in one embodiment, a self-bonded pre-wound secondary winding that is assembled over tube 24 and includes a low voltage end and a high voltage end. In such an arrangement, the inside diameter (ID) of the pre-wound secondary may be made slightly greater than the outside diameter (OD) of polyimide tube 22 so as to allow encapsulant 50 to be introduced therebetween. In an alternate embodiment, secondary winding 30 may be wound onto the combination of tube 22, flange 26 and flange 28. In the illustrated embodiment, tube 22/flange 26/flange 28 is configured to receive one continuous secondary winding (e.g., progressive winding), as is known. The low voltage end may be connected to ground by way of a ground connection through LV connector body 38 by way of LV terminal 32, as described above. The high voltage end may be connected to spark plug contact 50 via high-voltage (HV) terminal 46 and spring 48 for electrically connecting the high voltage generated by secondary winding 30 to spark plug 14. Other arrangements for establishing such a connection will be recognized by those of ordinary skill in the art, and are within the spirit and scope of the present invention. As known, an interruption of a primary current $I_p$ through primary winding 18, as controlled by ignition system 12, is operative to produce a high voltage at the high voltage end of secondary winding 30. Winding 30 may otherwise be implemented using conventional approaches and material known to those of ordinary skill in the art.

In a second preferred embodiment, case 34 is formed using a tube of polyimide material, and may be used either (i) with a secondary winding spool formed of conventional materials such as PPO/PS or PBT (as described above), or (ii) in combination with polyimide tube 22/flange 26/flange 28 described above.

Polyimide material is robust to partial discharge but cannot be molded into a standard case configuration. The second preferred embodiment therefore uses a polyimide tube to form the main dielectric structure for case 34.

FIG. 1 shows a cross-sectional, enlarged view of case 34. Case 34 is generally cylindrical and includes inner and outer surfaces. The inner surface is configured in size to receive and retain the subassembly comprising core 16/primary winding 18/a secondary winding spool (or tube 22/flanges 26,28)/secondary winding 30.

Case 34 includes a first opening (top) and a second opening (bottom) opposite the first opening. The top opening of case 34 is sealed by low-voltage (LV) connector assembly 38, which may be formed using conventional thermoplastic material, such as thermoplastic polyester resin (e.g., Rynite® RE5220 available from E. I. Du Pont De Nemours and Company Wilmington, Del. USA). O-ring 42 or the like is configured to seal between the LV connector assembly 38 and the inside diameter surface of tube 34. Likewise, the bottom opening is sealed by HV connector assembly 40, which may also be formed using conventional thermoplastic materials such as thermoplastic polyester resin (e.g., Rynite® RE5220 available from E.I. Du Pont De Nemours and Company Wilmington, Del. USA). O-ring 44 or the like is configured to seal the HV connector assembly 40 and the ID surface of tube 34.

One advantage of polyimide case 34 is that a case capable of withstanding the high electric fields (E-fields) expected during its service life (e.g., >15 kvolts) can be made having a thickness in the range of between about 0.25 mm and 0.50 mm. This reduced thickness case would replace the case produced using conventionally-employed materials that is typically about 1.2 mm thick. The space savings would allow for either a small overall ignition coil, an increased output due to an increased core (that would be available in the same space), or a reduced cost by eliminating magnets (e.g., a permanent magnet disposed at one or more end surfaces of core 16) that would otherwise be required to obtain a desired output level (i.e., magnets not needed because the core and/or windings can be increased).

Three approaches are contemplated for producing polyimide case 34. It should be understood that the described approaches are exhaustive but rather are only limiting in nature. One approach involves using an extruded polyimide tube for polyimide case 34. Since this approach involves one thickness of material, rather than layers (described below in greater detail), the thickness may be between about 0.38 and 0.50 mm. An extrudable grade of polyimide would be needed to implement this approach.

A second approach provides the thinnest wall thickness of the three described approaches. In the second approach, polyimide tape is rolled in layers to yield an extremely thin-wall case. In one embodiment, a substantially continuous piece of tape is used wherein the tape width is the width of the final tube. In one embodiment, tape, such as Kapton® CR, a corona resistant polyimide material product from E.I. Du Pont De Nemours and Company, Wilmington, Del., USA may be used. In one embodiment, such tape may be 0.001 inch or 0.002 inch polyimide material with about a 0.001 inch acrylic or silicone adhesive. In one embodiment, a tube formed from five layers of 0.001 inch Kapton® CR with 0.001 inch adhesive would provide an ultimate dielectric strength of 37,000 Vrms, or 52 kV peak. The total thickness would be about 0.01 inch or 0.25 mm. Although other forms of polyimide tape are known in the art, and have similar ultimate dielectric strengths, thicker tape levels may be required in order to lower the electric field intensity at any particular point therethrough, since the materials are not as corona resistant. The foregoing described embodiment would save approximately 2 mm off the overall diameter compared to a standard configuration ignition coil assembly (i.e., a secondary winding outwardly of a primary winding, and a conventional material case). In the conventional case, the case thickness may be between about 1.0–1.2 mm thick (a wall thickness).

A third method according to the invention involves the use of a premade spiral-wound tube comprising polyimide material. Since a tube according to this approach would not have "solid" layers, such tube will require an increased thickness.

In still another embodiment according to the invention, an ignition coil includes a polyimide secondary winding spool and case, as described above. In such an embodiment, an encapsulant, such as liquid silicone rubber (LSR) could be used in lieu of a standard epoxy potting material. As described above, in such embodiment, if a prewound secondary winding were used, such LSR encapsulant could get between the secondary winding and the secondary winding spool (polyimide tube). Such a configuration would provide temperature capability that could be as high as approximately 200° C. At such levels, the wire would become the limiting factor. The temperature capability of current pencil coils is limited by namely the secondary spool material and the potting material (in some designs, possibly the case material too). The internal temperature that the coil operates at must be limited to about 165° C. because of the epoxy and secondary spool. Above this temperature, the spool or potting material may get soft and the coil may fail due to a spool punch through or a wire-to-wire short. As described, the secondary spool is made out of polyimide, the case is made out of polyimide, and the encapsulant is LSR. These materials are capable of handling much higher temperatures and they are no longer the reason why the internal temperature of the coil must be limited. Now that the case, spool, and encapsulant have been improved, the wire is now the "limiting factor." Currently, 220° C. is the highest temperature rating of secondary wire. Although the case, spool, and encapsulant can handle going to a higher operating temperature, the wire cannot. In addition, use of an LSR encapsulant provides a manufacturing advantage, relative to epoxy potting material. Moreover, respecting quality, layers of polyimide tape, such as Kapton® CR for the case, yields a more repeatable dielectric structure than, for example, a conventional injection molded thermoplastic.

FIG. 1 further shows a cross-sectional, exaggerated view of shield 36. Shield 36 is generally annular in shape and is disposed radially outwardly of case 34, and, preferably, engages outer surface of case 34. The shield 36 is preferably comprises electrically conductive material, and, more preferably metal, such as steel or other adequate magnetic material. Shield 36 provides not only a protective barrier for ignition coil 10 generally, but, further, provides a magnetic path for the magnetic circuit portion of ignition coil 10. Shield 36 may nominally be about 0.50 mm thick, in one embodiment. Shield 36 may be grounded by way of an internal grounding strap, finger or the like (not shown) well know to those of ordinary skill in the art.

Low voltage connector body 38 is configured to, among other things, electrically connect the first and second ends of primary winding 18 to an energization source, such as, the energization circuitry included in ignition system 12. Connector body 38 is generally formed of electrical insulating material, but also includes a plurality of electrically conductive output terminals 54 (e.g., pins for ground, primary winding leads, etc.). Terminals 54 are coupled electrically, internally through connector body 38, in a manner known to those of ordinary skill in the art, and are thereafter connected to various parts of coil 10, also in a manner generally know to those of ordinary skill in the art. Ignition system 12 may then control energization of the primary winding 18.

FIG. 1 further shows a cross-sectional view, with portions broken away, of HV connector assembly 40. HV connector assembly 40 may include a spring connection 48 or the like, which is electrically coupled between HV terminal 46 and contact 50. HV terminal 46 is in turn coupled to the high voltage lead of secondary winding 30. Contact 50 is configured to engage a high-voltage connector terminal of spark plug 14. This arrangement for coupling the high voltage developed by secondary winding 30 to plug 14 is exemplary only; a number of alternative connector arrangements, particularly spring-biased arrangements, are known in the art.

The potting material 52 may be introduced into potting channels defined (i) between primary winding 18 and polyimide secondary winding spool 22, and, (ii) between secondary winding 30 and polyimide case 34. The potting channels are filled with potting material, in the illustrated embodiment, up to approximately the level designated "L" in FIG. 1. The potting material performs the function of electrical insulation and, provides protection from environmental factors which may be encountered during the service life of ignition coil 10. There are a number of suitable epoxy potting materials well known to those of ordinary skill in the art. Moreover, as described, a liquid silicone rubber (LSR) material may be used when both the secondary winding spool and the case both comprise polyimide material.

What is claimed is:

1. An ignition coil assembly comprising a central core having a main axis;

a primary winding disposed about said core that is configured to be connected to a power source;

a secondary winding wound on a spool that is configured to be connected to a spark plug, said secondary winding being disposed outwardly of said primary winding; and a case radially outwardly of said secondary winding, said case comprising a first tube formed of polyimide material.

2. The assembly of claim 1 wherein said spool comprises a second tube formed of polyimide material.

3. An ignition coil assembly comprising a central core having a main axis;

a primary winding disposed about said core that is configured to be connected to a power source;

a secondary winding wound on a spool that is configured to be connected to a spark plug, said secondary winding being disposed outwardly of said primary winding; and a case radially outwardly of said secondary winding, said case comprising a first tube formed of polyimide material wherein said spool comprises a second tube formed of polyimide material, further comprising a magnetically-permeable core disposed outwardly of said case.

4. The assembly of claim 3 wherein said primary winding is wound directly on said central core.

5. The assembly of claim 4 further comprising a high-voltage (HV) connector assembly configured to seal a first end opening of said first tube.

6. The assembly of claim 5 further comprising an O-ring between said first tube and said HV connector assembly.

7. The assembly of claim 5 wherein said HV connector assembly comprises thermoplastic polyester resin material.

8. The assembly of claim 4 further comprising a low-voltage (LV) connector assembly configured to seal a second end opening of said first tube opposite said first end opening.

9. The assembly of claim 8 further comprising an O-ring intermediate said first tube and said LV connector assembly.

10. The assembly of claim 3 wherein said first tube is between about 0.25 and 1.2 mm thick.

11. The assembly of claim 10 wherein said first tube is between about 0.25 and 0.5 mm thick.

12. The assembly of claim 3 wherein said first tube is extruded.

13. An ignition coil assembly comprising a central core having a main axis;

a primary winding disposed about said core that is configured to be connected to a power source;

a secondary winding wound on a spool that is configured to be connected to a spark plug, said secondary winding being disposed outwardly of said primary winding; and a case radially outwardly of said secondary winding, said case comprising a first tube formed of polyimide material, wherein said first tube comprises a plurality of layers of polyimide material.

14. The assembly of claim 3 wherein said first tube is a spiral wound tube.

15. An ignition coil assembly comprising a central core having a main axis;

a primary winding disposed about said core that is configured to be connected to a power source;

a secondary winding wound on a spool that is configured to be connected to a spark plug, said secondary winding being disposed outwardly of said primary winding; and a case radially outwardly of said secondary winding, said case comprising a first tube formed of polyimide material, wherein said spool comprises a second tube formed of polyimide material, wherein said second tube includes a closed end and an open end.

* * * * *